US011122888B2

(12) United States Patent
Lee

(10) Patent No.: US 11,122,888 B2
(45) **Date of Patent: *Sep. 21, 2021**

(54) TABLE HEIGHT ADJUSTMENT SYSTEM AND METHOD OF USING THE SAME

(71) Applicant: Knoll, Inc., East Greenville, PA (US)

(72) Inventor: Jeffrey P. Lee, Mertztown, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/988,889

(22) Filed: Aug. 10, 2020

(65) Prior Publication Data

US 2020/0367641 A1 Nov. 26, 2020

Related U.S. Application Data

(63) Continuation of application No. 16/417,789, filed on May 21, 2019, now Pat. No. 10,779,638.

(60) Provisional application No. 62/680,118, filed on Jun. 4, 2018.

(51) Int. Cl.

| | |
|---|---|
| ***A47B 9/16*** | (2006.01) |
| ***A47B 21/02*** | (2006.01) |
| ***A47B 13/08*** | (2006.01) |
| *A47B 9/00* | (2006.01) |

(52) U.S. Cl.

CPC ..... *A47B 9/16* (2013.01); *A47B 13/088* (2013.01); *A47B 21/02* (2013.01); *A47B 2009/006* (2013.01)

(58) Field of Classification Search

CPC .. A47B 9/16; A47B 9/00; A47B 21/00; A47B 21/02; A47B 21/0314; A47B 2200/0066

USPC ..... 108/147, 144.11, 50.01, 50.02; 312/223.3

See application file for complete search history.

(56) References Cited

U.S. PATENT DOCUMENTS

| | | | |
|---|---|---|---|
| 4,604,955 | A | 8/1986 | Fleischer et al. |
| 5,224,429 | A | 7/1993 | Borgman et al. |
| 5,408,940 | A | 4/1995 | Winchell |
| 5,562,052 | A | 10/1996 | Glashouwer et al. |
| 5,598,789 | A | 2/1997 | Jonker |
| 5,706,739 | A | 1/1998 | Shaheen et al. |
| 5,715,761 | A | 2/1998 | Frattini |
| 5,881,979 | A | 3/1999 | Rozier, Jr. et al. |
| 5,941,182 | A | 8/1999 | Greene |
| 6,029,587 | A | 2/2000 | Rozier, Jr. et al. |
| 6,360,675 | B1 | 3/2002 | Jones |
| 6,389,988 | B1 | 5/2002 | Frattini |
| 6,536,357 | B1 | 3/2003 | Hiestand |
| 6,546,880 | B2 | 4/2003 | Agee |
| 8,056,489 | B2 | 11/2011 | Nielsen |
| 8,256,359 | B1 | 9/2012 | Agee |

(Continued)

*Primary Examiner* — Jose V Chen

(74) *Attorney, Agent, or Firm* — Buchanan Ingersoll & Rooney PC

(57) ABSTRACT

A table arrangement includes a height adjustment mechanisms for movement of one or more height adjustable tabletops. When more than one tabletop is present, each of the tabletops can be independently moveable. Embodiments of the table arrangement can be configured so that a user can manipulate an actuation mechanism to have the tabletop automatically moved to a pre-selected position without the user having to manually control the actuation mechanism to cause the tabletop to move to that pre-selected position.

20 Claims, 7 Drawing Sheets

(56) References Cited

U.S. PATENT DOCUMENTS

| | | | | |
|---|---|---|---|---|
| 8,667,909 | B2 | 3/2014 | Ruzicka | |
| 9,265,340 | B2 | 2/2016 | Krusin et al. | |
| 9,585,468 | B2 | 3/2017 | Udagawa et al. | |
| 9,612,849 | B1 | 4/2017 | Gildein, II et al. | |
| 9,723,920 | B1 | 8/2017 | Wu | |
| 10,779,638 | B2 * | 9/2020 | Lee | A47B 21/02 |
| 2008/0245279 | A1 | 10/2008 | Pan | |
| 2008/0289545 | A1 | 11/2008 | Picchio | |
| 2011/0075337 | A1 | 3/2011 | Riley et al. | |
| 2012/0126072 | A1 | 5/2012 | Pettersson | |
| 2013/0204438 | A1 | 8/2013 | Hjelm | |
| 2014/0137773 | A1 | 5/2014 | Mandel et al. | |
| 2015/0120238 | A1 | 4/2015 | Marvit et al. | |
| 2016/0051042 | A1 | 2/2016 | Koch | |
| 2016/0170402 | A1 | 6/2016 | Lindstrom | |
| 2016/0213140 | A1 | 7/2016 | Koch | |
| 2016/0260019 | A1 | 9/2016 | Riquelme Ruiz et al. | |
| 2016/0353880 | A1 | 12/2016 | Sigal et al. | |
| 2017/0052517 | A1 | 2/2017 | Tsai et al. | |
| 2017/0055720 | A1 | 3/2017 | Lin et al. | |
| 2017/0135587 | A1 | 5/2017 | Desroches | |
| 2017/0265641 | A1 | 9/2017 | Hansen | |
| 2017/0303680 | A1 | 10/2017 | Glockl | |
| 2017/0367477 | A1 | 12/2017 | Lin | |
| 2018/0279770 | A1 | 10/2018 | Crowe et al. | |
| 2019/0029412 | A1 | 1/2019 | Gibson et al. | |
| 2019/0053617 | A1 | 2/2019 | Laudadio | |
| 2019/0098994 | A1 | 4/2019 | Smed | |
| 2019/0223586 | A1 | 7/2019 | Hansen | |
| 2019/0246789 | A1 | 8/2019 | Chen | |
| 2019/0328129 | A1 | 10/2019 | Namala | |
| 2019/0369578 | A1 | 12/2019 | Xiang et al. | |
| 2020/0104762 | A1 | 4/2020 | Gibson et al. | |

* cited by examiner

TABLE HEIGHT ADJUSTMENT SYSTEM AND METHOD OF USING THE SAME

CROSS-REFERENCE TO RELATED APPLICATIONS

The present application is a continuation application of U.S. patent application Ser. No. 16/417,789, which claims priority to U.S. Provisional patent Application No. 62/680,118, filed on Jun. 4, 2018. The entirety of this provisional patent application is incorporated by reference herein.

FIELD OF INVENTION

The innovation relates to mechanisms that can be used in connection with height adjustable table arrangements. The innovation also relates to methods of making and using such apparatuses.

BACKGROUND OF THE INVENTION

Table arrangements can be utilized in different types of settings. In some office workplaces, tables can be arranged next to each other and separated via a cubicle system for example. In other arrangements, tables can be positioned in a large conference room for a conference. In yet other arrangements, a group of tables can be positioned near each other to facilitate collaborative work. Examples of tables and table arrangements can be appreciated from U.S. Patent Application Publication Nos. 2013/0204438 and 2012/0126072 and U.S. Pat. Nos. 9,585,468, 9,265,340, 8,667,909, 8,256,359, 8,056,489, 6,546,880, 6,536,357, 6,389,988, 6,029,587, 5,941,182, 5,881,979, 5,715,761, 5,706,739, 5,598,789, 5,562,052, 5,224,429, 5,408,940, and 4,604,955.

SUMMARY OF THE INVENTION

A new table arrangement is provided that can be configured to facilitate quick adjustment of tabletop positions. Such an arrangement can be utilized in tables, work space partition arrangements in which a table assembly may define one or more tabletops (e.g. desktops, tabletops, countertops, or other type of work surface) for a work area at least partially defined by one or more partitions or privacy screens. The table arrangement can include an actuator that is configured to facilitate automatic height adjustment of a tabletop to which the actuator is attached. For instance, providing a specific pre-selected type of input via the actuator can result in the actuator causing the tabletop to which that actuator is attached to move automatically to one of at least two different saved positions (e.g. a standing use position, a siting use position that is lower than the standing user position, etc.). The actuator can include a controller that receives the input providable via an actuator member that a user can manipulate, interprets the input as providing an instruction to automatically move the tabletop to a stored user-selected position, and then provides a signal to a height adjustment system connected to the tabletop so that the height adjustment system raises or lowers the tabletop to the position identified via the user input. In some embodiments, the actuator can also be configured so that the controller of the actuator can store settings defining minimum and maximum height positions for a work surface via the actuator to limit tabletop height adjustment travel to between the stored minimum and maximum positions to help ensure worker safety or to avoid damage to objects near the table arrangement and/or the table arrangement.

In some embodiments, a table arrangement can include an actuator connectable to a tabletop. The tabletop can be connected to a height adjustment system configured to vertically adjust a position of the tabletop between a first bottom position and a second top position. The actuator can include an actuator member that can be manipulatable to actuate the height adjustment system. The arrangement can also include a controller connected to the actuator. The controller can have a processor connected to a non-transitory computer readable medium (e.g. a non-transitory memory). The controller can be configured to store values corresponding to a first sitting position of the tabletop and a second standing position of the tabletop in the memory so that, in response to a first input provided via motion or touching of the actuator member, the controller communicates with the height adjustment system to cause motion of the tabletop to automatically move to a height corresponding to the first sitting position of the tabletop and, in response to a second input via motion or touching of the actuator member, the controller communicates with the height adjustment system to cause motion of the tabletop to automatically move to a height corresponding to the second standing position of the tabletop.

In some embodiments, the first input can be provided via successive downward movements of the actuator member that occur within a pre-selected tap time period and the second input can also provided via successive upward movements of the actuator member that occur within a pre-selected tap time period.

The second standing position can be a position that is a vertically higher position than the first sitting position. The controller can also be configured to store a maximum position and a minimum position in the computer readable medium (e.g. non-transitory memory) to limit motion of the tabletop. For instance, in some embodiments the controller can be configured to store a maximum position and a minimum position in memory to limit motion of the tabletop via a storage process so that a desired minimum height position is stored in the memory in response to one of: (i) actuating a first button of the actuator and subsequently contacting the second surface of the actuator member within a pre-selected storage time after the first button is actuated to store a current height of the tabletop as a minimum height position in non-transitory memory where the tabletop is stationary while the actuator member is contacted during the pre-selected storage time period after the first button is actuated; and (ii) pressing a second button of the actuator and then holding the actuator member in a downward position while the second button is pressed for a minimum setting period of time to store a current position of the tabletop as a minimum height position for the tabletop in the memory. A desired maximum height position can also be stored in the memory in response to one of: (a) pressing a second button of the actuator and then holding the actuator member in an upward position while the second button is pressed for a maximum setting period of time to store a current position of the tabletop as a maximum height position for the tabletop in memory of the controller and (b) actuating the first button of the actuator and subsequently contacting the first surface of the actuator member within a pre-selected storage time after the first button is actuated to store a current height of the tabletop as a maximum height position in the non-transitory memory of the controller while the tabletop is stationary while the actuator member is contacted during the pre-selected storage time period after the first button is actuated.

A method of adjusting a position of a tabletop is also provided. Embodiments of the method can include pressing an actuator member of an actuator attached to the tabletop upwardly or touching a first surface of the actuator member to actuate a height adjustment system connected to the tabletop for moving the tabletop vertically higher to a standing height position. The method can also include one of: (i) pressing a first button of the actuator while also holding the actuator member in an upward position for a pre-selected time period to store a current height of the tabletop as a programmed standing height position in non-transitory memory of a controller connected to the actuator member (the tabletop can be stationary while the first button is pressed and the actuator member is also held in the upward position) and (ii) actuating a first button of the actuator and subsequently contacting the first surface of the actuator member within a pre-selected storage time after the first button is actuated to store a current height of the tabletop as a programmed standing height position in non-transitory memory of the controller connected to the actuator member (the tabletop can be maintained as stationary while the actuator member is contacted during the pre-selected storage time period after the first button is actuated). Embodiments of the method can also include other steps. For instance, the method can also include pressing the actuator member downwardly or touching a second surface of the actuator member to actuate the height adjustment system connected to the tabletop for moving the tabletop vertically lower to a sitting position. Thereafter, one of the following steps can be performed: (a) pressing the first button while also holding the actuator member in a downward position for a pre-selected time period to store a current height of the tabletop as a programmed sitting height position in the memory (the tabletop being stationary while the first button is pressed and the actuator member is also held in the downward position) and (b) actuating the first button of the actuator and subsequently contacting the second surface of the actuator member within a pre-selected storage time after the first button is actuated to store a current height of the tabletop as a programmed sitting height position in the non-transitory memory of the controller connected to the actuator member (the tabletop being stationary while the actuator member is contacted during the pre-selected storage time period after the first button is actuated).

The method can also include other steps. For instance, embodiments of the method can include double tapping the actuator member upwardly or double tapping the first surface of the actuator member to actuate automatic motion of the height adjustment system via the controller to move the tabletop to the standing height position and double tapping the actuator member downward or double tapping the second surface of the actuator member to actuated automatic motion of the height adjustment system via the controller to move the tabletop to the sitting height position.

As another example of additional steps that method can utilize, embodiments of the method can include adjusting the tabletop to a desired minimum height position and subsequently performing one of: (i) pressing a second button of the actuator and then holding the actuator member in the downward position while the second button is pressed for a minimum setting period of time to store a current position of the tabletop as a minimum height position for the tabletop in memory of the controller (the tabletop being stationary while the second button is pressed and the actuator member is held) and (ii) actuating the first button of the actuator and subsequently contacting the second surface of the actuator member within a pre-selected storage time after the first button is actuated to store a current height of the tabletop as a minimum height position in non-transitory memory of a controller connected to the actuator member (the tabletop being stationary while the actuator member is contacted during the pre-selected storage time period after the first button is actuated). Embodiments of the method can also include adjusting the tabletop to a desired maximum height position and subsequently performing one of: (i) pressing a second button of the actuator and then holding the actuator member in the upward position while the second button is pressed for a maximum setting period of time to store a current position of the tabletop as a maximum height position for the tabletop in memory of the controller (the tabletop being stationary during while the second button is pressed and the actuator member is in the upward position during this maximum setting period of time), and (ii) actuating the first button of the actuator and subsequently contacting the first surface of the actuator member within a pre-selected storage time after the first button is actuated to store a current height of the tabletop as a maximum height position in the non-transitory memory of the controller connected to the actuator member (the tabletop being stationary while the actuator member is contacted during the pre-selected storage time period). The controller can be configured for preventing the height adjustment system from moving the tabletop higher than the maximum height position and preventing the height adjustment system from moving the tabletop lower than the minimum height position after the maximum height position and minimum height position for the tabletop are stored in the memory. Such a configuration can permit the controller to prevent the height adjustment system from being actuated to move between its top position and bottom position by further limiting the travel of the height adjustment system. This can allow a user to provide an additional level of safety to account for a particular arrangement in which a table arrangement may be included (e.g. a work office setting in which the table is used as a desktop or countertop, or an arrangement in which full motion to the tabletop bottom position would affect a device below the tabletop and possibly cause damage to that device or the tabletop, etc.).

In some embodiments, the first button is a finger button and the second button is a recessed button within a housing of the actuator that is actuatable via a mechanical tool that is passable through a hole in the housing of the actuator to engage the second button. The hole in the housing for the recessed button may be small enough to prevent a user's finger from being inserted into the hole to press the button to ensure a user is required to purposefully use a mechanical tool to depress the recessed button or otherwise actuate that button.

The method can also include yet other steps. For example, the second button and the first button can both be pressed for a cancellation period of time to delete the stored maximum height position and the minimum height position from the memory. The pressing of these first and second buttons can occur at the same time or within a pre-selected time period of each other to actuate such cancelling.

As yet another example of additional steps, after the programmed standing height position is saved in the memory, embodiments of the method can include pressing the actuator member of an actuator attached to the tabletop to actuate the height adjustment system for moving the tabletop to a new standing height position and pressing the first button of the actuator while also holding the actuator member in the upward position for the pre-selected time period to delete the programmed standing height position from the memory and store a current height of the tabletop as the programmed standing height position in the memory of the controller. The tabletop can be stationary while the first button is pressed and the actuator member is also held in the upward position.

As yet another example of additional steps of the method, after the programmed sitting height position is saved in the memory, the method can include pressing the actuator member to actuate the height adjustment system for moving the tabletop vertically to a new sitting position. Thereafter, the first button can be pressed while also holding the actuator member in the downward position for the pre-selected time period to delete the programmed siting height position from the memory and store a current height of the tabletop as the programmed sitting height position in the memory. The tabletop can be stationary while the first button is pressed and the actuator member is also held in the downward position.

In other embodiments of the method of adjusting a position of a tabletop, the method can include pressing an actuator member of an actuator attached to the tabletop upwardly or touching a first surface of the actuator member to actuate a height adjustment system connected to the tabletop for moving the tabletop vertically higher to a maximum height position. Then, one of the following can be performed: (i) pressing a first button of the actuator while also holding the actuator member in an upward position for a maximum setting period of time to store a current height of the tabletop as a programmed maximum position in non-transitory memory of a controller connected to the actuator member (the tabletop being stationary while the first button is pressed and the actuator member is also held in the upward position during the maximum setting period of time) and (ii) actuating a first button of the actuator and subsequently contacting the first surface of the actuator member within a pre-selected storage time after the first button is actuated to store a current height of the tabletop as a maximum height position in non-transitory memory of a controller connected to the actuator member (the tabletop being stationary while the actuator member is contacted during the pre-selected storage time period after the first button is actuated). The actuator member can then be moved downwardly or a second surface of the actuator member can be touched to actuate the height adjustment system connected to the tabletop for moving the tabletop to a minimum height position. Thereafter, one of the following can be performed: (a) pressing the first button while also holding the actuator member in a downward position for a minimum setting period of time to store a current height of the tabletop as a programmed minimum position in the memory (the tabletop being stationary while the first button is pressed and the actuator member is also held in the downward position) and (b) actuating the first button of the actuator and subsequently contacting the second surface of the actuator member within a pre-selected storage time after the first button is actuated to store a current height of the tabletop as a minimum height position in non-transitory memory of the controller connected to the actuator member (the tabletop being stationary while the actuator member is contacted during the pre-selected storage time period after the first button is actuated). The controller can prevent the height adjustment system from moving the tabletop higher than the maximum height position and preventing the height adjustment system from moving the tabletop lower than the minimum height position after the maximum height position and minimum height position for the tabletop are stored in the memory.

A table arrangement is also provided in which the arrangement includes an actuator connectable to a tabletop. The actuator can have an actuator member. The tabletop can be connected to a height adjustment system configured to vertically adjust a position of the tabletop between a first bottom position and a second top position. A controller can be connected to the actuator. The controller can include a processor connected to a non-transitory memory. The controller can be configured to store values corresponding to a maximum height position of the tabletop and a minimum height position of the tabletop in the memory so that, in response to first input provided via downward motion of the actuator member or touching of a second surface of the actuator member, the controller communicates with the height adjustment system to actuate motion the tabletop so that vertical height adjustment of the tabletop is prevented from moving lower than the minimum height position and, in response to a second input via upward motion of the actuator member or touching of a first surface of the actuator member, the controller communicates with the height adjustment system so that the vertical height adjustment of the tabletop is prevented from moving higher than the maximum height position. It should be appreciated that the maximum height position can be lower than the second top position and the minimum height position can be higher than the first bottom position.

The table arrangement can also be arranged so that the controller and the actuator are configured so that minimum height setting input is provided via holding the actuator member in a downward position while a first button of the actuator is pressed for a minimum height setting period of time to store a current height of the tabletop as the minimum height position in the memory. The controller can be configured so that the tabletop is stationary while the first button is pressed and the actuator member is held in the downward position. In other embodiments, the controller and the actuator can be configured so that maximum height setting input is provided via holding the actuator member in an upward position while a first button of the actuator is pressed for a maximum height setting period of time to store a current height of the tabletop as the maximum height position in the memory. The controller can be configured so that the tabletop is stationary while the first button is pressed and the actuator member is held in the upward position.

In other embodiments, the controller and actuator can be arranged and configured so that actuating the first button of the actuator and subsequently contacting the second surface of the actuator member within a pre-selected storage time after the first button is actuated to store a current height of the tabletop as a minimum height position in non-transitory memory of the controller connected to the actuator member. A maximum height position can also be saved via a first button of the actuator being actuated and the first surface of the actuator member subsequently being contacted within a pre-selected storage time after the first button is actuated to store a current height of the tabletop as a maximum height position in non-transitory memory of a controller connected to the actuator member. The controller can be configured so that the tabletop is stationary while the actuator member is contacted during the pre-selected storage time period after the first button is actuated for storage of the maximum height position or minimum height position.

The controller can be configured so that the height adjustment system is not actuated to adjust a height of a tabletop under certain conditions associated with receiving input for storing a position of the tabletop (e.g. max position, min. position, sitting height position, standing height position, etc.). Such conditions can include—(1) when the first button is actuated, (2) when the second button is actuated, (3) when both the first and second button is actuated, (4) when the first button is actuated and for a pre-selected period of time after the first button is actuated (e.g. a storage saving time period that may be defined to run after the first button is actuated to facilitate entrance of a new stored position of the tabletop), and/or (5) when the second button is actuated and for a pre-selected period of time after the second button is actuated (e.g. a storage saving time period that may be defined to run after the second button is actuated to facilitate entrance of a new stored position of the tabletop). Other conditions can also, or alternatively, be utilized as well to configure the controller so that the height adjustment system is not actuated to adjust a height of a tabletop under certain conditions associated with receiving input for storing a position of the tabletop.

Other details, objects, and advantages of the invention will become apparent as the following description of certain exemplary embodiments thereof and certain exemplary methods of practicing the same proceeds.

BRIEF DESCRIPTION OF THE DRAWINGS

Exemplary embodiments of a table arrangement and height adjustment system used in the table arrangement are shown in the accompanying drawings and certain exemplary methods of making and practicing the same are also illustrated therein. It should be appreciated that like reference numbers used in the drawings may identify like components.

DETAILED DESCRIPTION OF EXEMPLARY EMBODIMENTS

Figure 1:
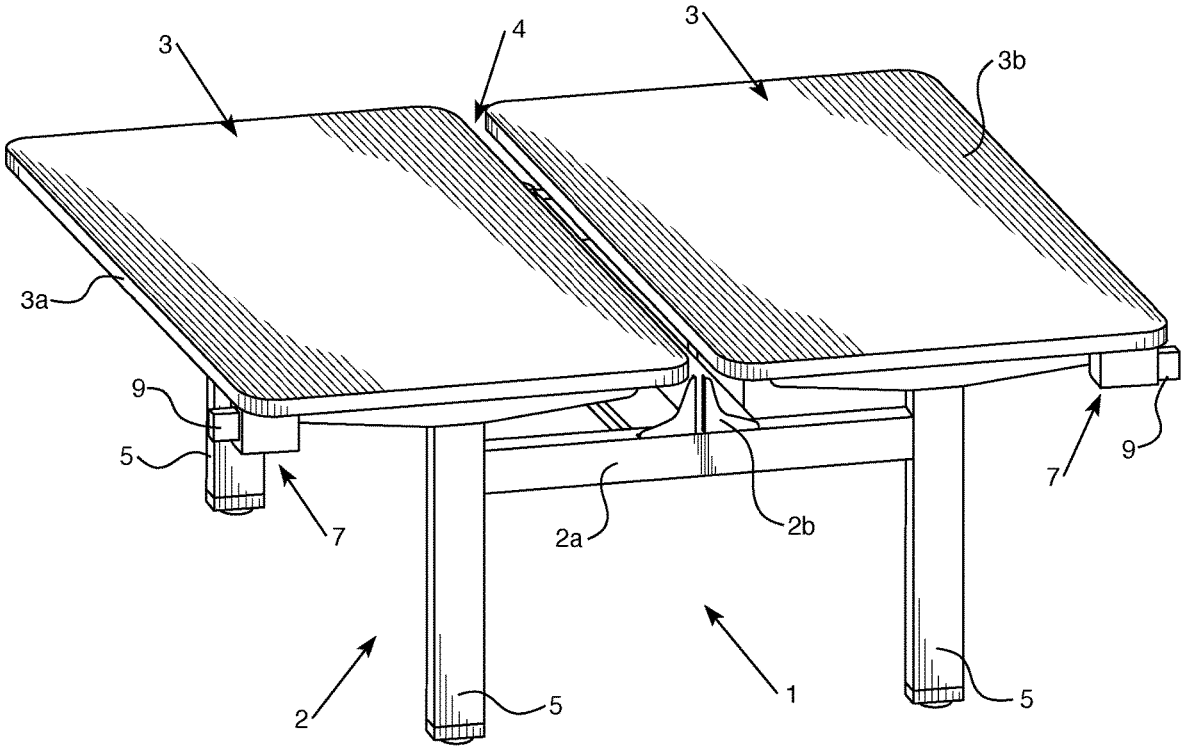
FIG. 1 is a perspective view of a first exemplary embodiment of a table arrangement 1 having multiple tabletops 3 that are independently height adjustable such that a first tabletop 3*a* is moveable to a different vertical position than a second tabletop 3*b*.
Figure 2:
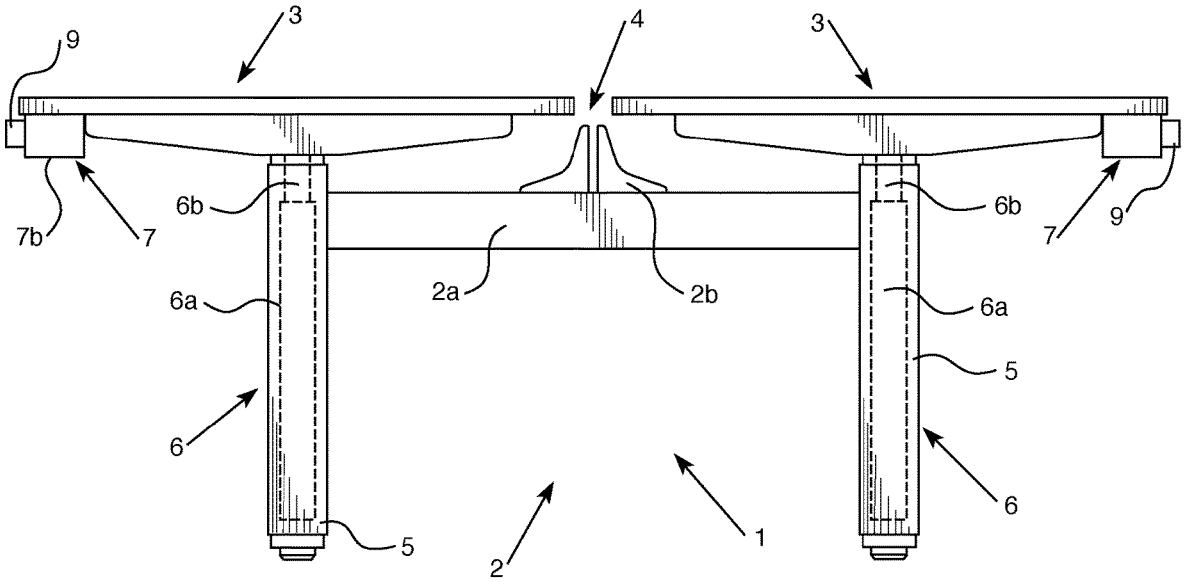
FIG. 2 is a side view of the first exemplary embodiment of the table arrangement 1.
Figure 3:
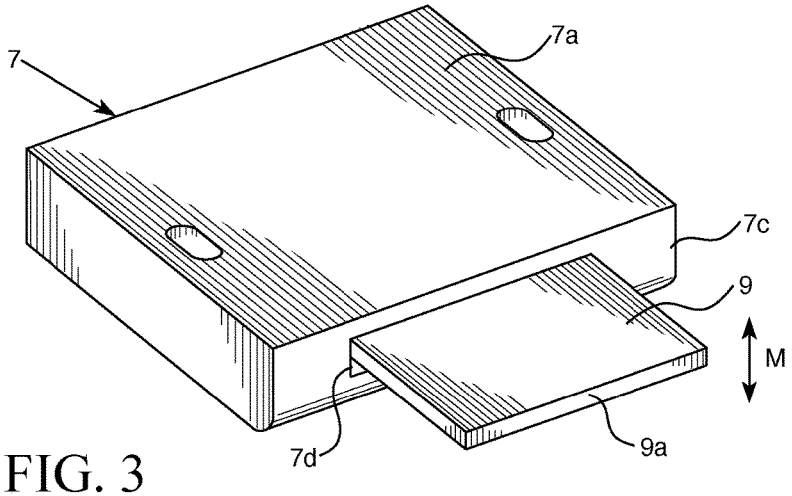
FIG. 3 is a perspective top view of an exemplary actuation mechanism for actuation of the height adjustment system that is utilized in the first exemplary embodiment of the table arrangement 1.
Figure 4:
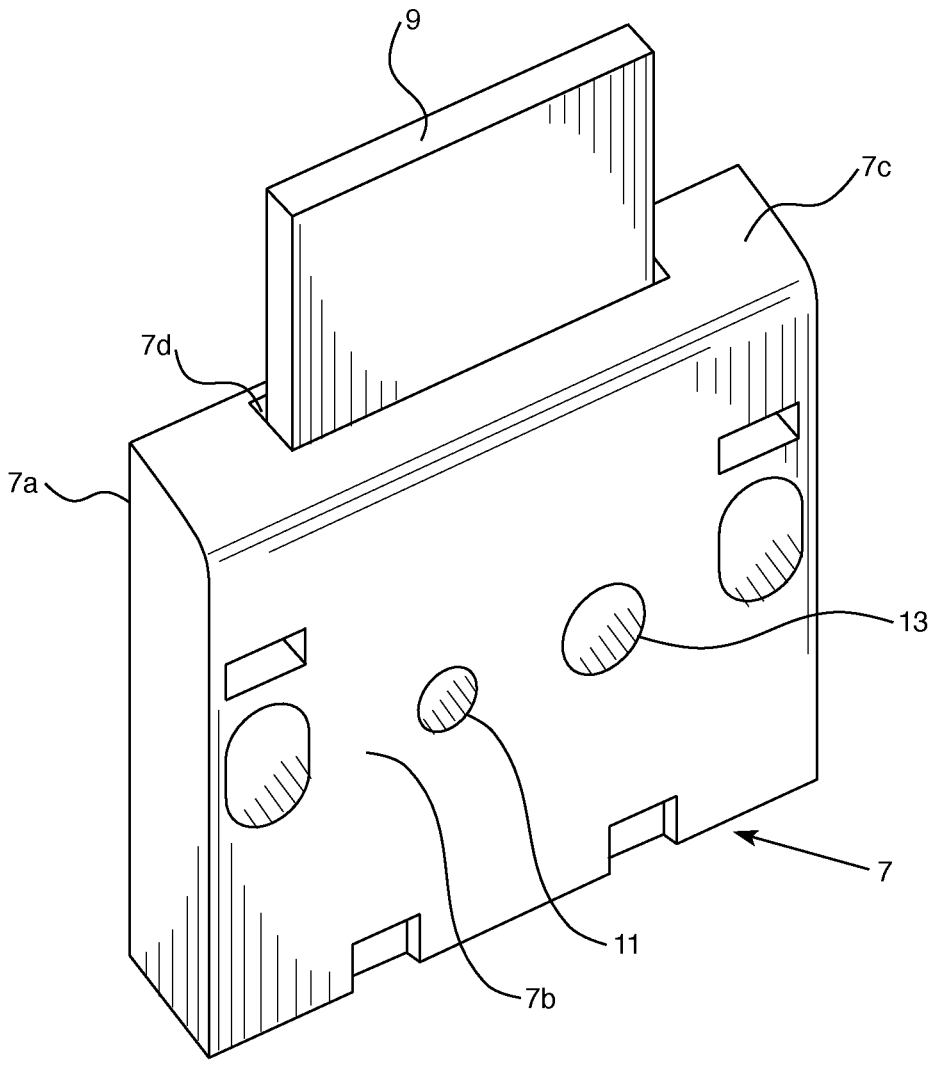
FIG. 4 is a perspective bottom view of the exemplary actuation mechanism for actuation of the height adjustment system that is utilized in the first exemplary embodiment of the table arrangement 1.
Figure 5:
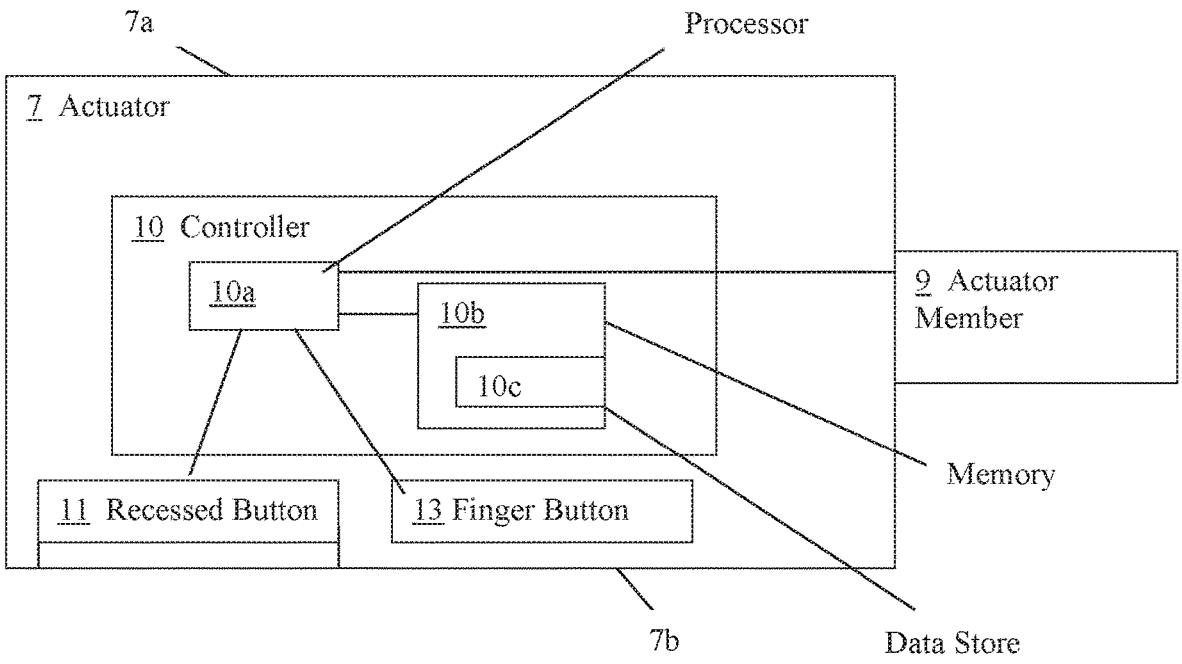
FIG. 5 is a block diagram of the exemplary actuation mechanism for actuation of the height adjustment system that is utilized in the first exemplary embodiment of the table arrangement 1.

Referring to FIGS. 1-8 a table arrangement 1 can include an assembly that includes multiple tabletops 3 that are supported by a base 2. The base can include a plurality of columns 5 and cross-members 2*a*. Each cross member 2*a* can be positioned on a respective side of the table tops and extend between spaced apart columns 5. For instance, each cross-member 2*a* can extend between a first column 5 that is connected to principally support a first tabletop 3 and a second column 5 that is positioned to principally support a second tabletop 3. For some table arrangements, the table arrangement could be considered two adjacent tables. In other table arrangement embodiments, the table arrangement can be considered a workspace arrangement, or cubicle type arrangement in which each tabletop 3 could be considered a work surface, a desktop, or a countertop. This can particularly be the case for office type settings in which an embodiment of the table arrangement may be utilized in connection with privacy screens, partition systems, or other office furniture layout elements. In other embodiments, there may only be columns 5 that support a single tabletop 3 such that the table arrangement is considered a single table.

In embodiments in which there are multiple tabletops 3 supported by a base 2, a gap 4 can be defined between adjacent tabletops 3 in an intermediate section or central section of the assembly. The gap 4 can be defined between the peripheral edges of the tabletops 3 that face each other. At least cable routing member 2*b* can extend below the gap between a first cross member 2*a* extending along and below a first sides of the tabletops 3 and a second cross-member 2*a* extending along and below second sides of the tabletops 3. The cable routing member 2*b* can be configured to facilitate the routing of power cables, data cables or other wiring. In other embodiments the cable routing member 2*b* can also (or alternatively) be configured to connect to a privacy screen for positioning of a partition body or screen body so that a screen body can extend vertically between the tabletops 3.

Each of the columns 5 can extend vertically along their length from a floor and the cross-members 2*a* can extend horizontally along their length between the first and second columns 5 to which it is connected. The first and second tabletops 3 can be positioned so that the tabletops' rear edges are spaced apart from each other to define the gap 4. Each of the tabletops can have a front edge 3*a* positioned on the side of the tabletop opposite its rear edge that faces toward the gap 4 and helps define the gap 4.

The columns 5 can be positioned so that first columns 5 are positioned under the first tabletop 3 and the second columns 5 are positioned under the second tabletop 3. For instance, there can be a pair of first columns 7 that are spaced apart from each other and are located on opposite sides (e.g. left and right sides) of the first tabletop 3 near a middle section of the first tabletop 3 and there can be a pair of second columns 5 that are spaced apart from each other and are located on opposite sides (e.g. left and right sides) of the second tabletop 3 near a middle section of the second tabletop 3.

Each column 5 can be configured to facilitate height adjustment of a tabletop 3. For example, the first columns 5 can be positioned adjacent a middle portion of the first tabletop 3 on opposite sides of the first tabletop between front and rear sides of the tabletop 3. Each first column 5 can include a telescoping member 6*b* that is extendable and retractable from a lower receptacle member 6*a* positioned inside the column 5 so that actuation of the telescoping member 6*b* results in height adjustment of the tabletop 3 between a lowermost position to an uppermost position. As another example, the second columns 5 can be positioned adjacent a middle portion of the second tabletop 3 on opposite sides of the second tabletop 3 between front and rear sides of the tabletop 3. Each second column 5 can include a telescoping member 6*b* that is extendable and retractable from a lower receptacle member 6*a* positioned inside of the column 5 so that actuation of the telescoping member 6*b* results in height adjustment of the tabletop 3 between a lowermost position and an uppermost position.

The table arrangement 1 can include a tabletop height adjustment system that includes at least one height adjustment mechanism 6 and an actuator 7 connected to at least one height adjustment mechanism 6. In some embodiments, each column 5 can include a height adjustment mechanism 6 (e.g. a gas spring, hydraulic spring, etc.) that is connected to the telescoping member 6*b* and the receptacle member 6*a* to drive motion of the telescoping member 6*b*. The height adjustment mechanisms 6 of the columns 5 that support a respective tabletop 3 can be coupled to an actuator 7 so that movement of an actuator member 9 o the actuator can result in causing the telescoping members 6*a* positioned in the columns 5 to move to facilitate height adjustment of the tabletop 3. For instance, a user may utilize the actuator 7 by manipulating the actuator member 9 to provide input for actuation of the height adjustment mechanism 6 so that the telescoping members 6*a* are vertically moveable for adjusting a position of a tabletop 3.

The actuator member 9 can extend from a third side 7*c* of the actuator housing. In some embodiments, the actuator member 9 can extend from an opening 7*d* defined in the third side 7*c* of the actuator hosing (e.g. a channel in communication with a mouth defined in the third side 7*c* for receipt of an inner end of the actuator member 9, a slot defined in the actuator housing below the first side 7*a* that has a mouth defined in the third side 7*c* from which a portion of the actuator member 9 extends, etc.). The actuator member 9 of the actuator 7 can be configured as a paddle in some embodiments. The paddle can be configured as a lever, a handle, or other type of moveable actuator (e.g. a knob or a button, etc.). The actuator member 9 can be moveably connected to a housing of the actuator 7 so that the actuator member is moveable in multiple movement directions M (e.g. at least a distal end 9*a* of the actuator member 9 is moveable in multiple movement directions M). For instance, the actuator member 9 can be moveable downwardly and upwardly. Such motion can be configured to be rotatable or pivotable via a horizontal axle-based connection the inner end of the actuator member 9 can have to the actuator housing within the opening that is at least partially defined in the third side 7*c* of the actuator housing or can be linearly downward and upward motion via a vertically moving slideable connection the actuator member 9 can have to the actuator housing (e.g. via a vertically elongated slot defined via the actuator housing, etc.). Such motion can alternatively be due to a resilient connector or other type of moveable connection mechanism that connects the actuator member 9 to the housing of the actuator 7. At least one spring or other type of biasing mechanism can be connected to the actuator member 9 to bias the actuator member to an initial position. A user may need to provide a force to cause the actuator member to move upwardly or downwardly relative to this initial position to provide input for causing the actuator 7 to control movement of height adjustment mechanisms 6 for adjusting a position of the tabletop 3 to which the actuator 7 is attached.

The actuator housing can include a first side 7*a* that may be a top of the housing that is configured to be fastened to the underside of a tabletop 3. In other embodiments, the first side 7*a* could be another side of the actuator housing for connecting to the tabletop (e.g. a bottom configured for connecting to the top surface or a side configured for connecting to an outer peripheral edge of the tabletop, etc.).

A second side 7*b* of the actuator housing opposite the first side 7*a* can define a plurality of apertures that are configured to receive and/or provide access to input mechanisms positioned on, positioned within, or attached to the second side 7*b* of the housing 7. The input mechanisms can include a finger button 13 and a recessed button 11, for example. The input mechanisms can be communicatively connected to a controller 10 so a user can manipulate the input mechanisms with his or her hands to provide input to the controller 10 for use in controlling the height adjustment mechanisms 6. The third side 7*c* of the actuator housing can extend between the first side 7*a* and the second side 7*b* and be positioned so that the actuator member 9 extends from the actuator housing below the tabletop 3 to which the actuator housing is attachable.

The recessed button 11 can be positioned below the outermost surface of the second side 7*b* of the actuator housing within a recess or defined hole that is sized smaller than the size of the finger button 13. The size of the recess can be configured so that a user is required to use a mechanical tool, like an end of a paper clip or a smaller rod or pin to insert into the aperture defining to contact the recessed button 11 to engage the button 11 to move it from an initial position to a second position for providing input to a processor 10*a* of a controller 10 communicatively connected to the recessed button 11. The finger button 13 can be coupled to the second side 7*b* of the actuator housing and be configured to be depressable or otherwise engageable via at least one finger of a user's hand (e.g. contract by the finger, the finger being within a proximity of the finger button 13, etc.) to provide input to the controller 10 (e.g. processor 10*a* of the controller 10).

Figure 6:
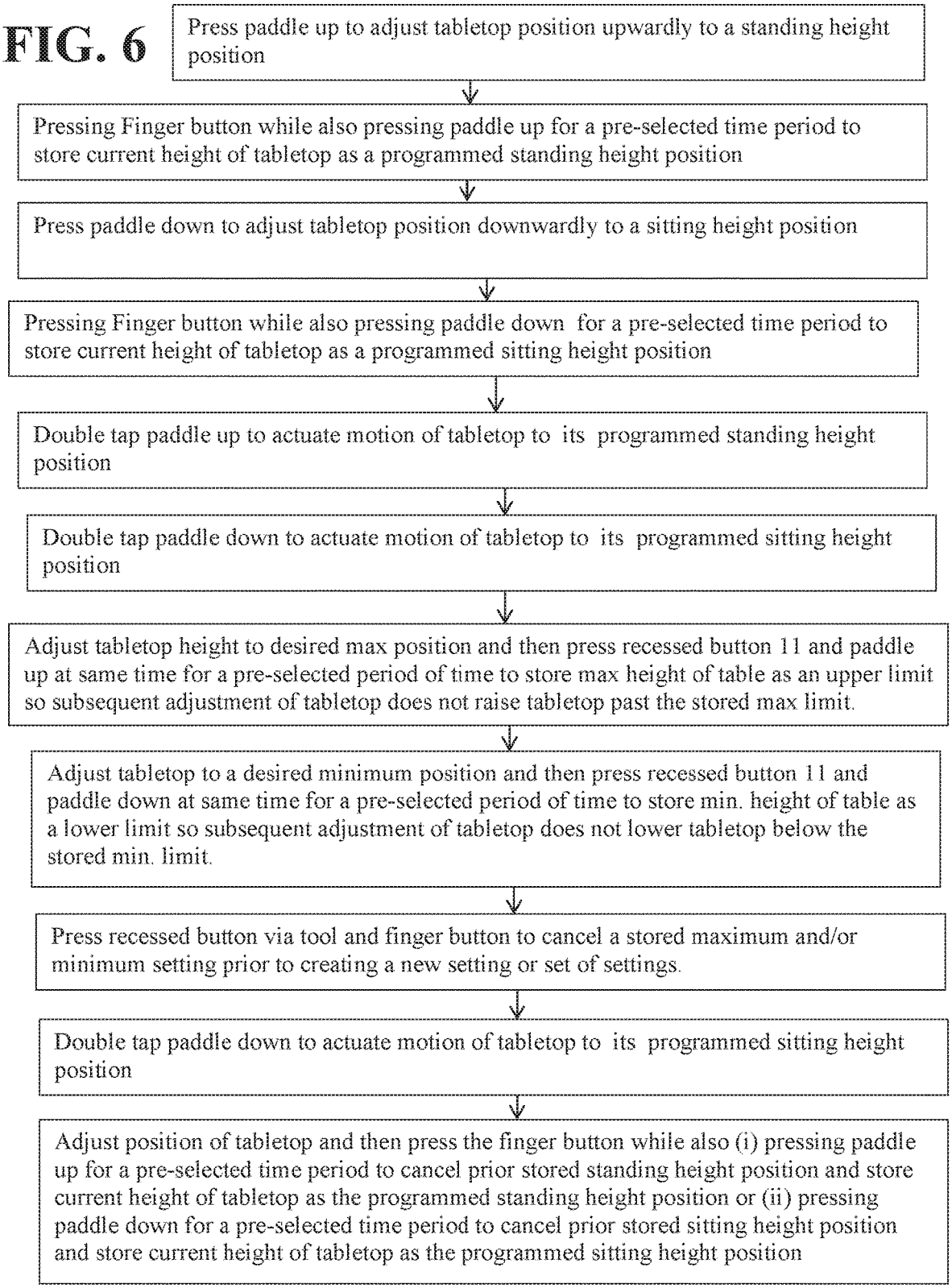
FIG. 6 is a flow chart illustrating an exemplary method of using the height adjustment system included in the first exemplary embodiment of the table arrangement 1.
Figure 7:
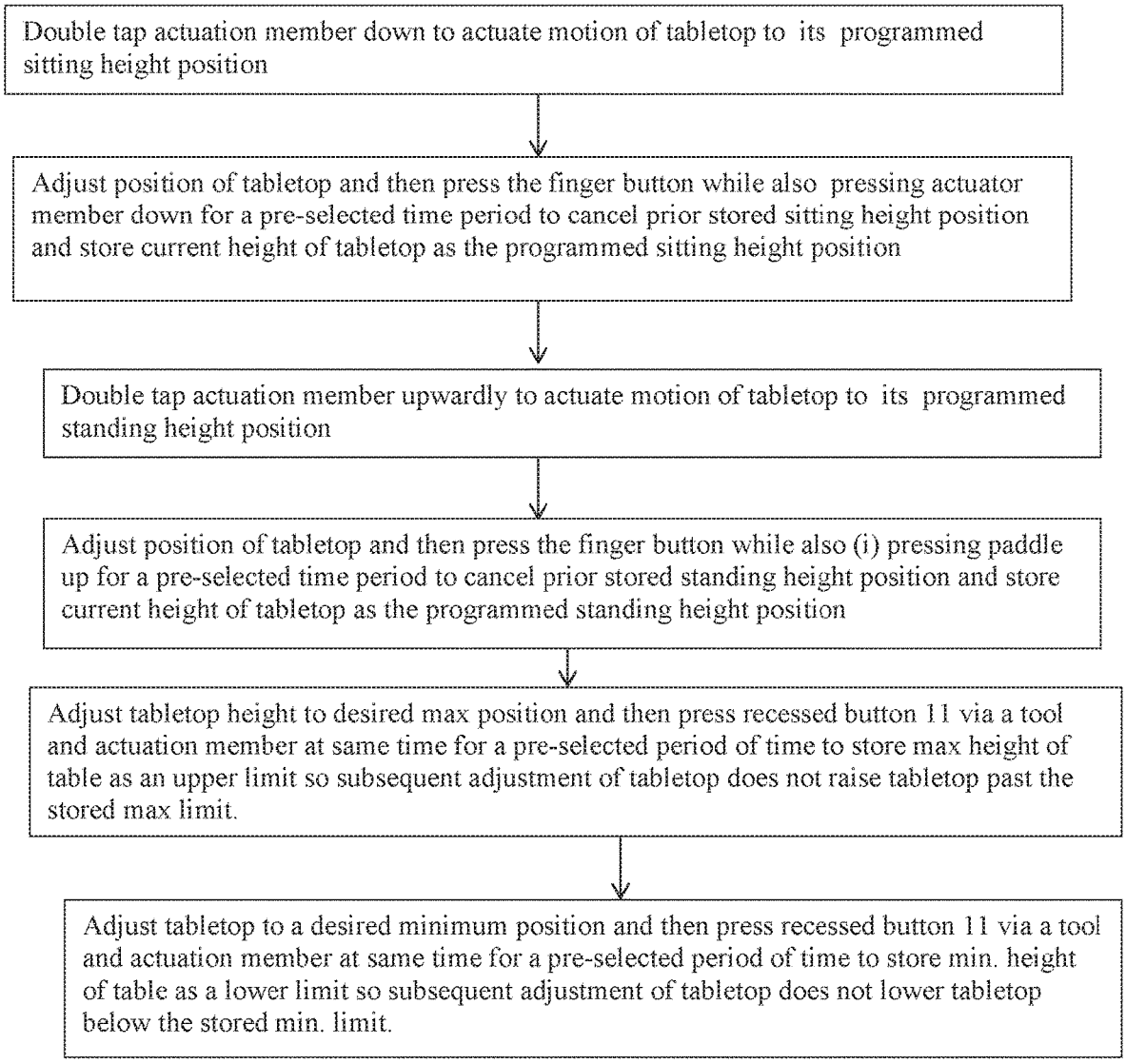
FIG. 7 is a flow chart illustrating another exemplary method of using the height adjustment system included in the first exemplary embodiment of the table arrangement 1.
Figure 8:
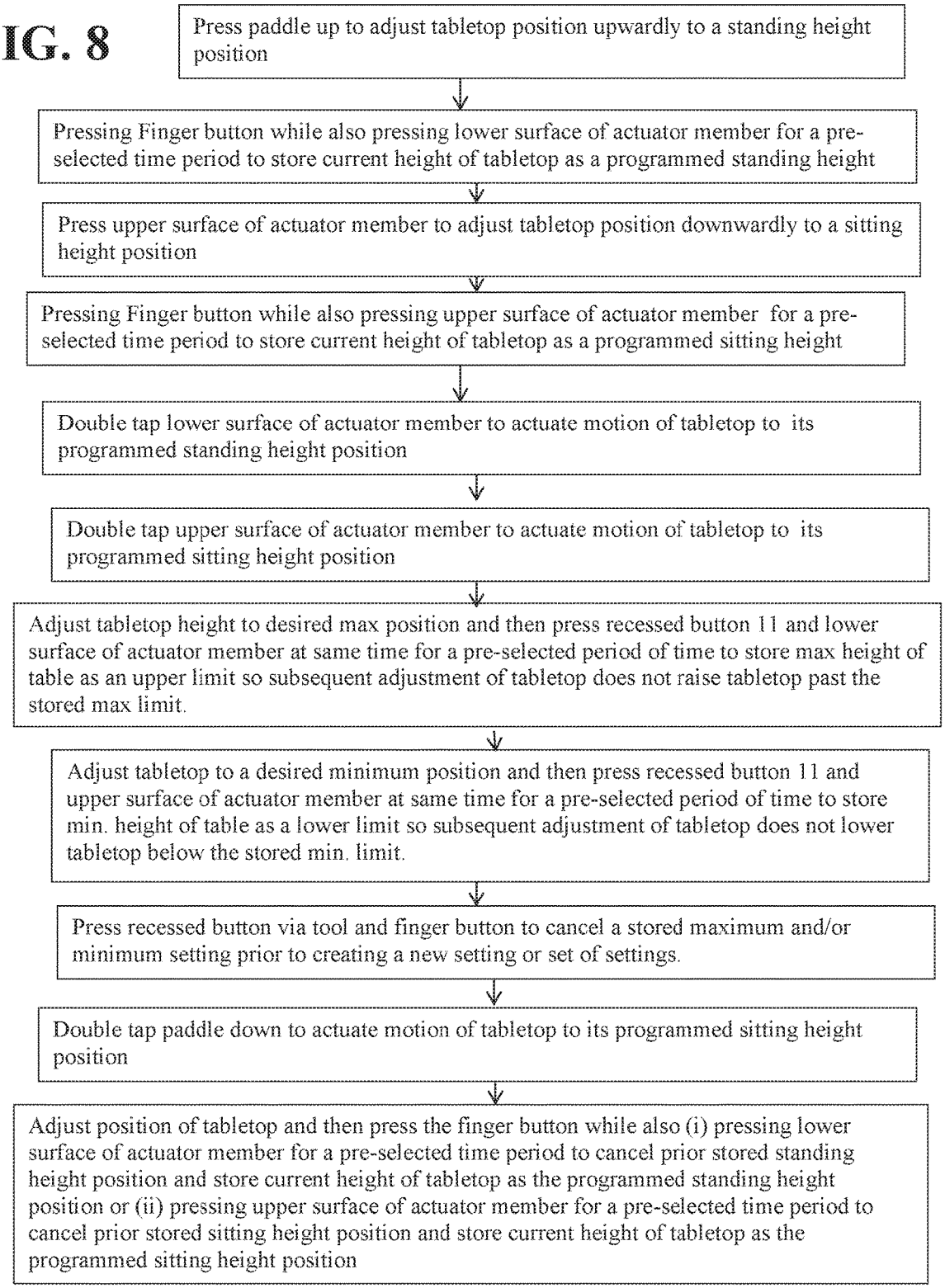
FIG. 8 is a flow chart illustrating yet another exemplary method of using the height adjustment system included in the first exemplary embodiment of the table arrangement 1.

It should be understood that the controller 10 can be an electronic device that includes hardware. The controller 10 can include at least one processor 10*a* (e.g. a microprocessor or other type of hardware processor), non-transitory memory 10*b* connected to the processor 10*a* (e.g. flash memory, a hard drive, other type of non-transitory computer readable medium, etc.), and other elements such as a transmitter and a receiver, a transceiver, etc. The memory can include at least one data store 10*c* that can be accessed by the processor and/or at least one application that can be run by the processor 10*a*. The processor 10*a* can be configured to cause a method of controlling the height adjustment system for the tabletop 3 to be performed in connection with user inputs provided via one or more input mechanisms and/or the actuator member 9 based on code stored in the memory 10*b* that is executable by the processor 10*a*. Examples of such a method are shown in FIGS. 6-8.

For instance, the processor 10*a* can be configured to respond to input provided via the actuator member 9, finger button 13 and/or recessed button 11 for controlling the height adjustment mechanisms 6 connected to the actuator 7. The input that is provided can be utilized by the processor 10*a* to control the position of the tabletop 3 so that the vertical position of the tabletop 3 attached to the actuator 7 is vertically adjustable to a different position in response to motion of the actuator member 9. The finger button 13 and recessed button 11 can be used to also provide input for storing information in a data store 10*c* that is storable in non-transitory memory 10*b* that is connected to the processor 10*a* that can be utilized by the processor for controlling motion of the tabletop 3 via the height adjustment system (e.g. height adjustment mechanisms 6 connected to the actuator 7, etc.).

In some embodiments, the actuator 7 can include the controller 10 and can be configured to facilitate automatic adjustment of tabletop positions between a sitting position for positioning a tabletop 3 to support a user who is sitting near the tabletop and a vertically higher standing position of the tabletop 3 to position the tabletop for use when the user is standing near the tabletop 3 (as compared to sitting). The movements of the tabletop 3 between these positions can be constrained by saved minimum and maximum position settings that may be set and stored at the controller 10 as well. The controller 10 can also be configured so that a user can cancel the max or minimum limit settings so that these settings can be erased or erased and subsequently have new values saved for such settings. The controller 10 can also be configured to permit overwriting of a stored sitting position value and/or stored standing position value as well (e.g. cancellation of deletion of a prior setting and subsequent saving of a new value for the setting).

For instance, the actuator 7 can be configured so that when a user moves the actuator member 9 upwardly and holds it in the upward position, the controller 10 is configured to communicate with the height adjustment mechanisms 6 to cause vertically upward motion of the tabletop by extending telescoping member 6*a* that are connected to the tabletop 3 to which the actuator 7 is attached upwardly. The actuator 7 can also be configured so that when a user moves the actuator member 9 downwardly and holds it in the downward position, the controller 10 is configured to communicate with the height adjustment mechanisms 6 to cause vertically downward motion of the tabletop 3 by retracting the telescoping members 6*a* that are connected to the tabletop 3 to which the actuator 7 is attached upwardly.

The actuator 7 can be alternatively be configured so that when a user touches a bottom surface of the actuator member 9 (e.g. touches the bottom surface with one or more fingers without moving the actuator member 9 or by causing an upward flexing motion of the actuator member 9), the controller 10 is configured to sense that touching and communicate with the height adjustment mechanisms 6 to cause vertically upward motion of the tabletop by extending telescoping member 6*a* that are connected to the tabletop 3 to which the actuator 7 is attached upwardly. The actuator 7 can also be configured so that when a user touches the top surface of the actuator member 9, the controller 10 is configured to communicate with the height adjustment mechanisms 6 to cause vertically downward motion of the tabletop 3 by retracting the telescoping members 6*a* that are connected to the tabletop 3 to which the actuator 7 is attached upwardly. The touching of the actuator member 9 can result in the actuator member 9 not moving or being flexed for motion. A user may use his or her hand or one or more fingers to provide this touching in some embodiments. In yet another configuration, a touching of a top surface of the actuator member 9 can result in upward height adjustment via the controller 10 and the touching of a bottom surface of the actuator member 9 can result in a downward height adjustment of the tabletop.

A touch sensitive sensor, a proximity sensor, or other type of sensor can be included in the actuator member 9 or adjacent the actuator member 9 to provide the input to the controller 10. In some embodiments, there may only be one such sensor for detecting the touching of the actuator member 9 at the top surface and bottom surface of the actuator member 9. In other embodiments, there may be a first sensor located at or near the top surface of the actuator member 9 to detect touching of the top surface of the actuator member and a second sensor located at or near the bottom surface of the actuator to detect touching of the bottom surface of the actuator member.

It should be understood that the bottom surface of the actuator member 9 can be considered a first surface and the top surface of the actuator member 9 can be considered a second surface of the actuator member or that, alternatively, the bottom surface of the actuator member 9 can be considered the second surface and the top surface of the actuator member 9 can be considered the first surface of the actuator member.

The controller 10 of the actuator 7 can also be configured to store a first value that corresponds to a sitting position of the tabletop and a second value that corresponds to the standing position of the tabletop for a user. For example, after the tabletop is vertically adjusted to a position that a user likes for use of the tabletop 3 when the user is sitting in a chair at the table (e.g. adjacent a peripheral edge of the tabletop 3), the user may then use one or more of the user's fingers to engage the finger button 13 while the user also presses the actuator member down and holds the actuator member 9 in the downward position while engaging the finger button 13 for a pre-selected period of time (e.g. 3 seconds, 5 seconds, 2 seconds, etc.). The actuator 7 can be configured so that no adjustment to the position of the tabletop occurs when the finger button 13 is engaged and the actuator member is also in a downward or upward position. The actuator can be configured so that height adjustment mechanisms are only instructed to change the position of the tabletop in response to movement of the actuator member 9 to its downward position or upward position while the finger button 13 and recessed button 11 are also not engaged.

In response to the holding of the finger button 13 for the pre-selected period of time while the actuator member 9 is also in the downward position, the controller 10 can be configured to cause the non-transitory memory 10*b* to retain a value in a data store that links that current position of the tabletop 3 as being the sitting position of the tabletop 3. After that sitting position setting is stored, the controller 10 can be configured to respond to input provided as a double tap of the actuator member 9 to its downward position to cause the height adjustment mechanisms 6 to move the tabletop 3 to the height that corresponds to the stored sitting position. The double tapping input can be provided by a user moving the actuator member 9 to the downward position, then having the actuator member 9 move back to its initial position, and then again moving the actuator member to its downward position so that the second downward motion of the actuator member to its downward position occurs within a pre-selected tap time period to provide this double tap input (e.g. a "double tap"). The "double tap" can be provided such that the actuator member must be held and maintained in the downward position (e.g. the second tap of the double tap is kept by the user so the actuator member is held in the downward position for the second "tap" for at least a pre-selected hold time period) on the second tap or the "double tap" can be provided without such holding and maintaining of the actuator member in the downward position on the second successive tapping (e.g. the user can release the actuator member after the "double tap").

A user can overwrite the stored sitting position by following the same procedure used to initially save the stored sitting position. Following this same procedure can result in the old sitting position that was saved being deleted and the new sitting position being saved to replace that old sitting position.

The user can also store a setting for the standing position. This can occur before or after the setting for the sitting position is stored. For instance, after the tabletop is vertically adjusted to a position that a user likes for use of the tabletop 3 when the user is standing at the table (e.g. standing adjacent a peripheral edge of the tabletop 3 to use a laptop or otherwise use the tabletop for work), the user may then use one or more of the user's fingers to engage the finger button 13 while the user also presses the actuator member upward and holds the actuator member 9 in the upward position while engaging the finger button 13 for a pre-selected period of time (e.g. 3 seconds, 5 seconds, 2 seconds, etc.). The actuator 7 can be configured so that no adjustment to the position of the tabletop occurs when the finger button 13 is engaged and the actuator member is also in the upward position. The actuator can be configured so that height adjustment mechanisms are only instructed to change the position of the tabletop in response to movement of the actuator member 9 to its upward position while the finger button 13 and recessed button 11 are also not engaged.

In response to the holding of the finger button 13 for the pre-selected period of time while the actuator member 9 is also in the upward position, the controller 10 can be configured to cause the non-transitory memory 10*b* to retain a value in a data store that links that current position of the tabletop 3 as being the standing position of the tabletop 3. After that standing position setting is stored, the controller 10 can be configured to respond to input provided via a double tap of the actuator member 9 to its upward position to cause the height adjustment mechanisms 6 to move the tabletop 3 to the height that corresponds to the stored standing position. The double tapping input can be provided by a user moving the actuator member to the upward position, then having the actuator member 9 move back to its initial position, and then again moving the actuator member to its upward position so that the second upward motion of the actuator member to its upward position occurs within a pre-selected tap time period to provide this double tap input (e.g. a "double tap"). The "double tap" can be provided such that the actuator member must be held and maintained in the upward position (e.g. the second tap of the double tap is kept by the user so the actuator member is held in the upward position for the second "tap" for at least a pre-selected hold time period) or the second tap of the "double tap" can be provided without such holding and maintaining of the actuator member in the upward position on the second successive tapping (e.g. the user can release the actuator member 9 after the "double tap").

A user can overwrite the stored standing position by following the same procedure used to initially save the stored standing position. Following this same procedure can result in the old standing position that was saved being deleted and the new standing position being saved to replace that old sitting position.

A user can also store maximum and minimum positional settings for the tabletop via the controller 10. Such settings can prevent vertical motion of the tabletop beyond these minimum or maximum positions. Such stored settings can help ensure a user is only able to adjust a table within a pre-selected range of vertical positions to help ensure the safety of the user or to ensure that the tabletop 3 is not moved into another adjacent structure that may cause damage to the tabletop, an item on the tabletop, or another structure.

For instance, after the tabletop is vertically adjusted to a position that is desired to be a maximum vertical position of the tabletop 3 via use of the actuator 7 to cause the height adjustment mechanisms 6 to extend telescoping members 6*b* via upward motion of the actuator member 9 to its upward position, the user may then stop motion of the tabletop 3 so it stays in this desired maximum height position. The user may then use a mechanical tool (e.g. portion of a paper clip, thin metal rod or pin, nail, etc.) to pass through a hole or other aperture in the second side 7*b* of the actuator housing to contact the recessed button 11 to press or otherwise engage the recessed button to an actuation position (e.g. a depressed position) and maintain that recessed button in that position while also subsequently using a hand to move the actuator member 9 to an upward position so that the actuator member 9 is in the upward position while the recessed button is in an actuation position for a pre-selected max setting period of time (e.g. 5 seconds, 6 seconds, 7 seconds, etc.). The pre-selected max setting period of time can be a time period that is longer than the time period used to save values for setting the sitting position and/or standing position.

In other embodiments, the maximum setting can be stored via input provided by the user using a finger to depress the finger button 13 while also using another hand to manipulate the mechanical tool (e.g. portion of a paper clip, thin metal rod or pin, nail, etc.) to pass through a hole or other aperture in the second side 7*b* of the actuator housing to contact the recessed button 11 to press or otherwise engage the recessed button to an actuation position (e.g. a depressed position) and maintain that recessed button in that position while also subsequently actuating the finger button (e.g. via depressing the button) while the recessed button is in an actuation position for a pre-selected max setting period of time (e.g. 5 seconds, 6 seconds, 7 seconds, etc.). The actuator member 9 can be required to be in it is initial position when the recessed button 11 and the finger button 13 are being manipulated for providing this input for setting the maximum position and saving it in the memory 10*b* of the controller 10.

After this maximum position setting is saved, the controller 10 can be configured so that the height adjustment mechanism 6 is not communicated with to cause further upward motion of the tabletop 3 after the tabletop 3 is determined to be at the maximum position. Once this maximum position is reached, the controller 10 can be configured to no longer respond to cause the height adjustment mechanisms 6 to move the tabletop higher in response to the actuator member 9 being in the upward position.

After the tabletop is vertically adjusted to a position that is desired to be a minimum vertical position of the tabletop 3 via use of the actuator 7 to cause the height adjustment mechanisms 6 to retract telescoping members 6*b* via downward motion of the actuator member 9 to its downward position, the user may then stop motion of the tabletop 3 so it stays in this desired minimum height position. The user may then use a mechanical tool (e.g. portion of a paper clip, thin metal rod or pin, nail, etc.) to pass through a hole or other aperture in the second side 7*b* of the actuator housing to contact the recessed button 11 to press or otherwise engage the recessed button to an actuation position (e.g. a depressed position) and maintain that recessed button in that position while also subsequently using a hand to move the actuator member 9 to a downward position so that the actuator member 9 is in the downward position while the recessed button is in an actuation position for a pre-selected minimum ("min.") setting period of time (e.g. 5 seconds, 6 seconds, 7 seconds, etc.). The pre-selected min. setting period of time can be a time period that is longer than the time period used to save values for setting the sitting and/or standing positions. It can be the same time period as the pre-selected max time period of time or another time period. The actuator member 9 can be required to be in it is initial position when the recessed button 11 and the finger button 13 are being manipulated for providing this input for setting the minimum position and saving it in the memory 10*b* of the controller 10.

In other embodiments, the minimum setting can be input via the controller 10 and actuator 7 by the user using one or more of the user's fingers to engage the finger button 13 while the user also uses a mechanical tool (e.g. portion of a paper clip, thin metal rod or pin, nail, etc.) to pass through a hole or other aperture in the second side 7*b* of the actuator housing to contact the recessed button 11 to press or otherwise engage the recessed button to an actuation position (e.g. a depressed position) and maintain that recessed button 11 in that position for the pre-selected min. setting period of time (e.g. 5 seconds, 6 seconds, 7 seconds, etc.).

After this minimum position setting is saved, the controller can be configured so that the height adjustment mechanism 6 is not communicated with to cause further downward motion of the tabletop 3 after the tabletop 3 is determined to be at the minimum position. Once this minimum position is reached, the controller 10 can be configured to no longer respond to cause the height adjustment mechanisms 6 to move the tabletop lower in response to the actuator member 9 being in the downward position. Such a setting can help ensure the tabletop 3 is not able to be moved by a user into a low position that may contact a structure below the table that may cause damage to the structure of the tabletop 3.

The stored maximum and minimum settings can be deleted or cancelled via cancellation input provided by a user manipulating the actuator 7 to communicate input to the controller 10. For example, the controller 10 can be configured to delete the min. and max position settings stored in the memory 10*b* of the controller 10 in response to a user actuating the finger button 13 and using a mechanical tool to engage the recessed button to depress or otherwise actuate the recessed button 11. These two buttons may need to be actuated and maintained in their actuated positions (e.g. depressed positions) for a cancellation period of time (e.g. 5 seconds, 10 seconds, etc.). The cancellation period of time can be the same time period as the time period used to set the min. or max settings or may be a longer or shorter time period. In some embodiments, the controller 10 can be configured so that deletion of the max and min. settings also results in deletion and cancellation of the sitting and standing position settings. In other embodiments, the sitting and standing positions that may be stored in the memory 10*b* may not be deleted when the min. and max settings are deleted from the memory 10*b*.

The setting and storage of a sitting height position, standing height position, maximum position and/or minimum position can be effected in other ways. For instance, in some embodiments, the setting of the maximum height position or the standing position can be effected by a user using a mechanical tool to depress or otherwise actuate the recessed button 11 and subsequently moving the actuator member 9 upwardly or touching the bottom surface of the actuator member 9 within a pre-selected position storage time period to have the current position of the tabletop stored as the maximum height position or the standing position of the tabletop (or for storage of that position and overwriting of a previously stored position). The controller can also be configured so that, when the actuator member 9 is manipulated by a user during the storage time period after the recessed button 11 is actuated, the height of the tabletop is not adjusted in response to touching or manipulation of the actuator member 9 so that only storage of the current position of the tabletop occurs in response to a manipulation of the actuator member 9 during the storage time period. Once stored, a double tap input (e.g. double touching of the bottom surface of the actuator member or double tap motion of the actuator member 9 in the upward direction) can communicate an input to the controller so that the height of the tabletop is moved automatically to that stored position.

As another example, the setting of the minimum height position or the sitting position can be effected by a user using a mechanical tool to depress or otherwise actuate the recessed button 11 and subsequently moving the actuator member 9 downwardly or touching the top surface of the actuator member 9 within a pre-selected position storage time period to have the current position of the tabletop stored as the minimum height position or the sitting position of the tabletop (or for storage of that position and overwriting of a previously stored position). The controller can also be configured so that, when the actuator member 9 is manipulated by a user during the storage time period after the recessed button 11 is actuated, the height of the tabletop is not adjusted in response to touching or manipulation of the actuator member 9 so that only storage of the current position of the tabletop occurs in response to a manipulation of the actuator member 9 during the storage time period. Once stored, a double tap input (e.g. double touching of the top surface of the actuator member 9 or double tap motion of the actuator member 9 in the downward direction) can communicate an input to the controller so that the height of the tabletop is moved automatically to that stored position.

As yet another example, the controller can be configured so that the finger button 13 and recessed button 11 are to be depressed in a pre-selected sequence or at the same time prior to the storage time period running in which the actuator member is to be contacted or moved to store a current position in the controller. Once the storage time period is started to run via actuation of the finger button 13 and recessed button 11 in the pre-selected sequence, manipulation of the actuator member 9 can occur as discussed herein to store the current position of the tabletop as a sitting position, standing position, maximum height position and/or minimum height position (e.g. upward touching on a bottom surface of the actuator member or movement of the actuator member can cause a standing position or maximum height position to be stored and/or downward touching on a top surface or downward motion of the actuator member can cause the current position of the tabletop to be stored as a sitting position or minimum height position).

It should be appreciated that the controller 10 can be configured so that the height adjustment system is not actuated to adjust a height of a tabletop under certain conditions associated with receiving input for storing a position of the tabletop (e.g. max position, min. position, sitting height position, standing height position, etc.). Such conditions can include—(1) when the recessed button 11 is actuated (e.g. depressed, engaged, etc.), (2) when the finger button 13 is actuated (e.g. depressed, engaged, etc.), (3) when both the recessed and finger buttons 11 and 13 are actuated, (4) when the recessed button 11 is actuated and for a pre-selected period of time after the recessed button is actuated (e.g. a storage saving time period that may be defined to run after the recessed button 11 is depressed or otherwise engaged to facilitate entrance of a new stored position of the tabletop), and/or (5) when the finger button 13 is depressed or otherwise engaged to actuate the button and for a pre-selected period of time after the finger button 13 is actuated (e.g. a storage saving time period that may be defined to run after the finger button is depressed or engaged to facilitate entrance of a new stored position of the tabletop). Other conditions can also, or alternatively, be utilized in conjunction with at least some of these conditions to configure the controller so that the height adjustment system is not actuated to adjust a height of a tabletop under certain conditions associated with receiving input for storing a position of the tabletop.

It should be appreciated that for embodiments of the actuator member 9 that do not require motion of the actuator member 9 to communicate input to the controller discussed herein, the "double tap" input feature (in embodiments in which the controller is configured to utilize this feature) can be provided such that the actuator member 9 must be touched on a surface of the actuator member twice within a pre-selected time period and the second touch of this double tap is held on the actuator member surface (e.g. the second tap of the double tap is kept by the user so the actuator member is held for the second "tap" for at least a pre-selected hold time period) on the second tap or the "double tap" can be provided without such holding and maintaining of the actuator member on the second successive tapping (e.g. the user can stop contacting the actuator member immediately after the second touch of the "double tap").

It should be understood that embodiments of the table arrangement 1 and height adjustment mechanisms used in that embodiment may be configured to meet different design criteria. For example, the shape and composition of the tabletop can be any of a number of suitable parameters to meet a particular design criteria. As another example, the tabletops 3 may be height adjustable and also be pivotable or otherwise moveable. As another example, the input mechanisms (e.g. finger button 13 and/or recessed button 11) can be other mechanisms for providing input to the processor 10*a* or other element of the height adjustment system (e.g. each could be a lever, knob, proximity sensors, haptic feedback sensor, etc.). As yet another example, the input provided to store a sitting position or standing position setting can be another type of input (e.g. a triple tap, another sequence of motions/actuations of the actuator member 9 and engagement/manipulation of at least one input mechanism, etc.). As yet another example, the bottom of each column may be configured to contact a floor, be connected to a foot for stationary positioning on the floor, or be connected to a rollable wheel or castor. As yet another example, there may be more than two columns 5 (e.g. three columns, four columns, etc.) under any particular tabletop 3 to principally support that tabletop in some embodiments of the table arrangement 1. As yet another example, the inner end of the actuator member 9 can be opposite the distal end 9*a* and be positioned within the actuator housing and be moveably connected therein for providing a moveable connection that permits at least the distal end 9*a* to be moved in different movement directions M in various different ways (e.g. pivot connection, axle based connection, resiliently deformable connection, slideable connection, etc.). As yet another example, it is contemplated that a particular feature described, either individually or as part of an embodiment, can be combined with other individually described features, or parts of other embodiments. Therefore, while certain exemplary embodiments of the table arrangement and height adjustment mechanisms used in the table arrangement and methods of making and using the same have been discussed and illustrated herein, it is to be distinctly understood that the invention is not limited thereto but may be otherwise variously embodied and practiced within the scope of the following claims.

What is claimed is:

1. A table arrangement comprising:

an actuator connectable to a tabletop, the actuator having an actuator member attached to the tabletop, the actuator member comprising a first side and a second side opposite the first side, an input mechanism being connected to the actuator member, the tabletop connected to a height adjustment system configured to vertically adjust a position of the tabletop between a first bottom position and a second top position; and a controller connected to the actuator, the controller having a processor connected to a non-transitory computer readable medium, the controller configured to store values corresponding to a first sitting position of the tabletop and a second standing position of the tabletop in the non-transitory computer readable medium so that, in response to a first input provided via motion or touching of the actuator member, the controller communicates with the height adjustment system to cause motion of the tabletop to automatically move to a height corresponding to the first sitting position of the tabletop and, in response to a second input via motion or touching of the actuator member, the controller communicates with the height adjustment system to cause motion of the tabletop to automatically move to a height corresponding to the second standing position of the tabletop.

2. The table arrangement of claim 1, wherein the second standing position is a vertically higher position than the first sitting position.

3. The table arrangement of claim 1, wherein:

the first input is provided via successive downward movements of the actuator member that occur within a pre-selected tap time period; and the second input is provided via successive upward movements of the actuator member that occur within a pre-selected tap time period.

4. The table arrangement of claim 3, wherein the controller is also configured to store a maximum position and a minimum position in the non-transitory computer readable medium to limit motion of the tabletop via the input mechanism.

5. The table arrangement of claim 1, wherein the first side of the actuator member has a first surface and the second side of the actuator member has a second surface and the input mechanism includes a first button recessed within the second surface and/or a second button positioned on the second surface, and the controller is also configured to store a maximum position and a minimum position in the non-transitory computer readable medium to limit motion of the tabletop via a storage process such that:

a desired minimum height position is stored in the non-transitory computer readable medium in response to one of:

(i) actuating the first button of the actuator and subsequently contacting the second surface of the actuator member within a pre-selected storage time after the first button is actuated to store a current height of the tabletop as a minimum height position in non-transitory computer readable medium, the tabletop being stationary while the actuator member is contacted during the pre-selected storage time period;

(ii) contacting the second button of the actuator and then holding the actuator member in a downward position while the second button is pressed for a minimum setting period of time to store a current position of the tabletop as a minimum height position for the tabletop in non-transitory computer readable medium; and a desired maximum height position is stored in the non-transitory computer readable medium in response to one of:

(a) pressing the second button of the actuator and then holding the actuator member in an upward position while the second button is pressed for a maximum setting period of time to store a current position of the tabletop as a maximum height position for the tabletop in the non-transitory computer readable medium of the controller, and (b) actuating the first button of the actuator and subsequently contacting the first surface of the actuator member within a pre-selected storage time after the first button is actuated to store a current height of the tabletop as a maximum height position in the non-transitory computer readable medium of the controller, the tabletop being stationary while the actuator member is contacted during the pre-selected storage time period.

6. A method of adjusting a position of a tabletop comprising:

manipulating a first surface of an actuator member that is attached to the tabletop such that the actuator member extends from the tabletop, the manipulating of the first surface of the actuator member actuating a height adjustment system connected to the tabletop for moving the tabletop vertically higher to a standing height position;

one of:

(i) contacting a first button positioned adjacent the actuator member while also holding the actuator member in an upward position for a pre-selected time period to store a current height of the tabletop as a programmed standing height position in a non-transitory computer readable medium of a controller connected to the actuator member, the second surface of the actuator member being opposite the first surface of the actuator member, the tabletop being stationary while the first button is contacted and the actuator member is also held in the upward position, and (ii) actuating the first button and subsequently touching the first surface of the actuator member within a pre-selected storage time after the first button is actuated to store a current height of the tabletop as a programmed standing height position in a non-transitory computer readable medium of a controller connected to the actuator member, the tabletop being stationary while the actuator member is touched during the pre-selected storage time period;

moving the actuator member downwardly or touching the second surface of the actuator member to actuate the height adjustment system connected to the tabletop for moving the tabletop vertically lower to a sitting position;

one of:

(a) contacting the first button while also holding the actuator member in a downward position for a pre-selected time period to store a current height of the tabletop as a programmed sitting height position in the memory, the tabletop being stationary while the first button is pressed and the actuator member is also held in the downward position, and (b) actuating the first button and subsequently touching the second surface of the actuator member within a pre-selected storage time after the first button is actuated to store a current height of the tabletop as a programmed sitting height position in non-transitory memory of a controller connected to the actuator member, the tabletop being stationary while the actuator member is touched during the pre-selected storage time period;

multiple tapping the actuator member upwardly or multiple tapping the first surface of the actuator member to actuate automatic motion of the height adjustment system via the controller to move the tabletop to the standing height position; and multiple tapping the actuator member downward or multiple tapping the second surface of the actuator member to actuated automatic motion of the height adjustment system via the controller to move the tabletop to the sitting height position.

7. The method of claim 6, wherein the first button is recessed within the second surface and a second button is positioned on the second surface of the actuator member, the method also comprising:

adjusting the tabletop to a desired minimum height position and subsequently performing one of:

(i) contacting the second button of the actuator and then holding the actuator member in the downward position while the second button is contacted for a minimum setting period of time to store a current position of the tabletop as a minimum height position for the tabletop in memory of the controller, (ii) actuating the first button of the actuator and subsequently touching the second surface of the actuator member within a pre-selected storage time after the first button is actuated to store a current height of the tabletop as a minimum height position in the non-transitory computer readable medium of the controller connected to the actuator member, the tabletop being stationary while the actuator member is contacted during the pre-selected storage time period; and adjusting the tabletop to a desired maximum height position and subsequently performing one of:

(i) contacting the second button of the actuator and then holding the actuator member in the upward position while the second button is contacted for a maximum setting period of time to store a current position of the tabletop as a maximum height position for the tabletop in the non-transitory computer readable medium of the controller, and (ii) actuating the first button of the actuator and subsequently touching the first surface of the actuator member within a pre-selected storage time after the first button is actuated to store a current height of the tabletop as a maximum height position in the non-transitory computer readable medium of the controller connected to the actuator member, the tabletop being stationary while the actuator member is touched during the pre-selected storage time period.

8. The method of claim 7, comprising:

the controller preventing the height adjustment system from moving the tabletop higher than the maximum height position and preventing the height adjustment system from moving the tabletop lower than the minimum height position after the maximum height position and minimum height position for the tabletop are stored in the non-transitory computer readable medium.

9. The method of claim 7, wherein the second button is a finger button and the first button is a recessed button, the method also comprising:

contacting the second button and the first button for a cancellation period of time to delete the stored maximum height position and the minimum height position.

10. The method of claim 6, wherein the first button is recessed within the second surface and a second button is positioned on the second surface of the actuator member, the method also comprising:

adjusting the tabletop to a desired minimum height position and subsequently touching the second button of the actuator and then holding the actuator member in the downward position while the second button is touched for a minimum setting period of time to store a current position of the tabletop as a minimum height position for the tabletop in the non-transitory computer readable medium of the controller.

11. The method of claim 6, the method also comprising:

adjusting the tabletop to a desired maximum height position and subsequently contacting the second button of the actuator and then holding the actuator member in the upward position while the second button is contacted for a maximum setting period of time to store a current position of the tabletop as a maximum height position for the tabletop in the non-transitory computer readable medium of the controller.

12. The method of claim 6, wherein the first button is a finger button or the first button is a recessed button that is actuatable via a mechanical tool that is passable through a hole in the housing of the actuator to engage the second button.

13. The method of claim 6, comprising:

after the programmed standing height position is saved in the non-transitory computer readable medium:

contacting the actuator member of an actuator attached to the tabletop to actuate the height adjustment system for moving the tabletop to a new standing height position; and contacting the first button of the actuator while also holding the actuator member in the upward position for the pre-selected time period to delete the programmed standing height position from the non-transitory computer readable medium and store a current height of the tabletop as the programmed standing height position in the non-transitory computer readable medium of the controller, the tabletop being stationary while the first button is contacted and the actuator member is also held in the upward position.

14. The method of claim 13, comprising:

after the programmed sitting height position is saved in the non-transitory computer readable medium:

contacting the actuator member to actuate the height adjustment system for moving the tabletop vertically to a new sitting position;

contacting the first button while also holding the actuator member in the downward position for the pre-selected time period to delete the programmed sitting height position from the non-transitory computer readable medium and store a current height of the tabletop as the programmed sitting height position in the memory, the tabletop being stationary while the first button is contacted and the actuator member is also held in the downward position.

15. The method of claim 6, comprising:

after the programmed sitting height position is saved in the non-transitory computer readable medium:

contacting the actuator member to actuate the height adjustment system for moving the tabletop vertically to a new sitting position;

contacting the first button while also holding the actuator member in the downward position for the pre-selected time period to delete the programmed siting height position from the non-transitory computer readable medium and store a current height of the tabletop as the programmed sitting height position in the non-transitory computer readable medium, the tabletop being stationary while the first button is contacted and the actuator member is also held in the downward position.

16. A method of adjusting a position of a tabletop comprising:

moving an actuator member upwardly or touching a first surface of the actuator member to actuate a height adjustment system connected to the tabletop for moving the tabletop vertically higher to a maximum height position, a first side of the actuator member being attached to the tabletop, one of:

(i) contacting a first button positioned adjacent a second side of the actuator member opposite the first side of the actuator member while also holding the actuator member in an upward position for a maximum setting period of time to store a current height of the tabletop as a programmed maximum position in a non-transitory computer readable medium of a controller connected to the actuator member, the tabletop being stationary while the first button is pressed and the actuator member is also held in the upward position, and (ii) actuating a first button positioned adjacent a second side of the actuator member opposite the first side of the actuator member and subsequently contacting the first surface of the actuator member within a pre-selected storage time after the first button is actuated to store a current height of the tabletop as a maximum height position in a non-transitory computer readable medium of a controller connected to the actuator member, the tabletop being stationary while the actuator member is contacted during the pre-selected storage time period;

pressing the actuator member downwardly or touching the second surface of the actuator member to actuate the height adjustment system connected to the tabletop for moving the tabletop to a minimum height position;

one of:

(a) contacting the first button while also holding the actuator member in a downward position for a minimum setting period of time to store a current height of the tabletop as a programmed minimum position in the non-transitory computer readable medium, the tabletop being stationary while the first button is pressed and the actuator member is also held in the downward position, and (b) actuating the first button of the actuator and subsequently contacting the second surface of the actuator member within a pre-selected storage time after the first button is actuated to store a current height of the tabletop as a minimum height position in the non-transitory computer readable medium of the controller connected to the actuator member, the tabletop being stationary while the actuator member is contacted during the pre-selected storage time period;

the controller preventing the height adjustment system from moving the tabletop higher than the maximum height position and preventing the height adjustment system from moving the tabletop lower than the minimum height position after the maximum height position and minimum height position for the tabletop are stored in the non-transitory computer readable medium.

17. A table arrangement comprising:

an actuator having an actuator member, a first side of the actuator member attached to a tabletop, the tabletop connected to a height adjustment system configured to vertically adjust a position of the tabletop between a first bottom position and a second top position;

a controller connected to the actuator, the controller having a processor connected to a non-transitory computer readable medium, the controller configured to store values corresponding to a maximum height position of the tabletop and a minimum height position of the tabletop in the non-transitory computer readable medium so that, in response to first input provided via downward motion of the actuator member or contacting of a second surface of the actuator member, the controller communicates with the height adjustment system to actuate motion the tabletop so that vertical height adjustment of the tabletop is prevented from moving lower than the minimum height position and, in response to a second input via upward motion of the actuator member or contacting of a first surface of the actuator member, the controller communicates with the height adjustment system so that the vertical height adjustment of the tabletop is prevented from moving higher than the maximum height position; and the first surface of the actuator member being a portion of the first side of the actuator member, the second surface of the actuator member being a portion of a second side of the actuator member that is opposite the first side.

18. The table arrangement of claim 17, wherein the maximum height position is lower than the second top position and the minimum height position is higher than the first bottom position.

19. The table arrangement of claim 18, wherein one of:

the controller and the actuator are configured so that minimum height setting input is provided via holding the actuator member in a downward position while a first button is actuated for a minimum height setting period of time to store a current height of the tabletop as the minimum height position in the non-transitory computer readable medium, the tabletop being stationary while the first button is actuated and the actuator member is held in the downward position; and the controller and the actuator are configured so that maximum height setting input is provided via holding the actuator member in an upward position while the first button is actuated for a maximum height setting period of time to store a current height of the tabletop as the maximum height position in the non-transitory computer readable medium, the tabletop being stationary while the first button is actuated and the actuator member is held in the upward position.

20. The table arrangement of claim 18, comprising:

a first button positioned adjacent to the second surface of the actuator member, the first button being recessed within the second surface or being a finger button on the second surface; and wherein:

the controller and the actuator are configured so that minimum height setting input is provided via one of:

(i) holding the actuator member in a downward position while the first button is actuated for a minimum height setting period of time to store a current height of the tabletop as the minimum height position in the non-transitory computer readable medium, the tabletop being stationary while the first button is actuated and the actuator member is held in the downward position, and (ii) actuating the first button of the actuator and subsequently contacting the second surface of the actuator member within a pre-selected storage time after the first button is actuated to store a current height of the tabletop as a minimum height position in the non-transitory computer readable medium of the controller connected to the actuator member, the tabletop being stationary while the actuator member is contacted during the pre-selected storage time period; and the controller and the actuator are configured so that maximum height setting input is provided via one of:

(a) holding the actuator member in an upward position while the first button is actuated for a maximum height setting period of time to store a current height of the tabletop as the maximum height position in the memory, the tabletop being stationary while the first button is actuated and the actuator member is held in the upward position, and (b) actuating the first button and subsequently contacting the first surface of the actuator member within a pre-selected storage time after the first button is actuated to store a current height of the tabletop as a maximum height position in the non-transitory computer readable medium, the tabletop being stationary while the actuator member is contacted and he first button is actuated during the pre-selected storage time period.

* * * * *